US008860319B2

(12) United States Patent
Naruo

(10) Patent No.: US 8,860,319 B2
(45) Date of Patent: Oct. 14, 2014

(54) LIGHTING DEVICE AND ILLUMINATION APPARATUS

(75) Inventor: Masahiro Naruo, Osaka (JP)

(73) Assignee: Panasonic Corporation, Osaka (JP)

( * ) Notice: Subject to any disclaimer, the term of this patent is extended or adjusted under 35 U.S.C. 154(b) by 225 days.

(21) Appl. No.: 13/416,052

(22) Filed: Mar. 9, 2012

(65) Prior Publication Data

US 2012/0242246 A1 Sep. 27, 2012

(30) Foreign Application Priority Data

Mar. 23, 2011 (JP) ..... 2011-064353

(51) Int. Cl.
*H05B 37/02* (2006.01)
*H05B 33/08* (2006.01)

(52) U.S. Cl.
CPC ..... *H05B 33/0818* (2013.01)
USPC ..... 315/186; 315/209 R; 315/224; 315/247; 315/291; 315/307

(58) Field of Classification Search
USPC ..... 315/186, 209 R, 224, 225, 246, 247, 315/291, 307, 308
See application file for complete search history.

(56) References Cited

U.S. PATENT DOCUMENTS 7,071,762 B2 7/2006 Xu et al.
8,525,442 B2 * 9/2013 Zimmermann et al. ..... 315/307
2003/0085749 A1 * 5/2003 Xu et al. ..... 327/423
2007/0188112 A1 8/2007 Kang et al.
2011/0292704 A1 * 12/2011 Makino et al. ..... 363/126

FOREIGN PATENT DOCUMENTS

CN 101022000 A 8/2007
JP 2006-511078 3/2006
JP 2010-198760 9/2010

OTHER PUBLICATIONS

Chinese Office Action dated Dec. 16, 2013 issued in corresponding Chinese application No. 201210060203.0 and the English translation thereof.

* cited by examiner

*Primary Examiner* — Douglas W Owens
*Assistant Examiner* — Thai Pham
(74) *Attorney, Agent, or Firm* — Bacon & Thomas, PLLC

(57) ABSTRACT

A lighting device includes: a series circuit of an inductor and a switching element; a diode which regenerates and supplies an energy of the inductor; and a control circuit which controls on/off of the switching element. The control circuit includes a drive signal generator which outputs a high frequency pulse drive signal; and a drive control section which turns on and off the switching element based on the high frequency drive signal and a PWM signal. The drive signal generator changes an ON time of the high frequency drive signal such that, after the PWM signal is changed from OFF to ON, a peak value of the load current gradually drops along an envelope of a specific slope, and the specific slope of the envelope is changed based on a duty ratio of the PWM signal.

12 Claims, 15 Drawing Sheets

LIGHTING DEVICE AND ILLUMINATION APPARATUS

FIELD OF THE INVENTION

The present invention relates to a lighting device for turning on solid state light emitting elements such as light emitting diodes (LEDs) and organic electroluminescent (EL) elements, and an illumination apparatus including the lighting device.

BACKGROUND OF THE INVENTION

Conventionally, as a lighting device for turning on the solid state light emitting elements, there is known a lighting device which has a control switch for supplying a constant current to the solid state light emitting elements, and supplies to the control switch a dual signal obtained by combining a high frequency drive pulse signal and a low frequency burst signal.

For example, in a power feeding assembly disclosed in Japanese Patent Application Publication No. 2006-511078, a dual signal obtained by performing an AND operation on a high frequency drive pulse signal and a low frequency PWM signal is supplied as a drive signal of a control switch. In the power feeding assembly, an average current flowing through the solid state light emitting elements is changed by changing a duty ratio of the low frequency PWM signal, and the solid state light emitting elements are turned on at a desired dimming level.

In this type of the lighting device, a dimmer being widely used for dimming of inverter type fluorescent lamps is used as a signal source outputting a PWM signal at a low frequency (about 1 kHz) since it can be supplied at a low cost. However, since a response speed of the solid state light emitting elements is faster than that of the fluorescent lamps, particularly, in case that the dimming level is low, there is a problem that a change in light output can be realized visually when the duty ratio of the PWM signal is changed.

Thus, there has also been proposed an LED lighting device including a dimming signal conversion circuit which operates by receiving a low frequency PWM signal outputted from this type of the dimmer, and converts it into a PWM signal with a variable pulse width in more multiple stages than the input PWM signal (see, e.g., Japanese Patent Application Publication No. 2010-198760). In such LED lighting device, the PWM signal is converted into the multi-stage PWM signal having more multiple stages by the dimming signal conversion circuit. Accordingly, while using a dimmer processing a small number of bits, it is possible to achieve a smooth change in dimming level as in case of using a dimmer processing a large number of bits.

Meanwhile, in the above-described lighting device, the drive signal of the control switch is an AND output of the high frequency drive pulse signal and the low frequency PWM signal. When a falling edge of the PWM signal is inputted while the control switch is in an ON state, the drive signal of the control switch becomes a low level. Accordingly, the ON period of the control switch is changed by a change in the low frequency PWM signal, and the current flowing through the solid state light emitting elements is changed, thereby changing the light output. Further, in the OFF period of the control switch, a regenerative current of an inductor included in the lighting device flows through the solid state light emitting elements. Thus, even if the PWM signal is changed during the OFF period of the control switch, the current flowing through the solid state light emitting elements does not change.

Therefore, as in the LED lighting device disclosed in Japanese Patent Application Publication No. 2010-198760, even if the duty ratio is continuously changed by artificially increasing the number of bits in the PWM signal, there is a problem such that the change in current flowing through the solid state light emitting elements is delayed and the light output is changed in a step shape (see FIG. 18). Particularly, in case that the dimming level is low, since a rate of change in light output is large, there is a problem that the change in light output is easily noticeable.

Further, when the light output of the solid state light emitting elements is seen through video equipment such as video cameras, a flicker that interferes with a specific frequency of the video equipment is visually seen. For that reason, it is necessary to set the frequency of the low frequency PWM signal to be higher than a predetermined value. Furthermore, when the frequency of the low frequency PWM signal increases, the light output for one cycle of the high frequency drive pulse signal of the control switch becomes larger. Therefore, it is necessary to further increase the frequency of the high frequency drive pulse. However, in case of increasing the frequency of the high frequency drive pulse, since the switching loss increases or the parts become expensive, it is difficult to significantly increase the frequency.

SUMMARY OF THE INVENTION

In view of the above, the present invention provides a lighting device and illumination apparatus capable of smoothing a change in illumination even at a low dimming level without increasing a frequency of a high frequency drive pulse of a control switch.

In accordance with an aspect of the present invention, there is provided a lighting device including: a series circuit of an inductor and a switching element switching an input from a DC power source; a diode which regenerates and supplies an energy of the inductor to solid state light emitting elements when the switching element is turned off; and a control circuit which controls on/off of the switching element, wherein the control circuit includes a drive signal generator which outputs a high frequency drive signal as a pulse signal to determine an amplitude of a load current flowing through the solid state light emitting elements; and a drive control section which turns on and off the switching element based on the high frequency drive signal and a PWM signal with a frequency lower than that of the high frequency drive signal, an on-duty of the PWM signal being changed according to a dimming level. Further, the drive signal generator changes an ON time of the high frequency drive signal such that, after the PWM signal is changed from OFF to ON, a peak value of the load current gradually drops along an envelope of a specific slope, and the specific slope of the envelope is changed based on a duty ratio of the PWM signal.

The lighting device may further include a current detection circuit which detects the load current flowing through the solid state light emitting elements; the control circuit may further include a threshold adjustment section which determines the peak value of the load current, and a comparator which compares an output of the current detection circuit with an output of the threshold adjustment section; and the drive signal generator may determine the ON time of the high frequency drive signal based on an output of the comparator.

The lighting device may further comprise a current detection circuit which detects the load current flowing through the solid state light emitting elements. The control circuit may further include a threshold adjustment section which determines the peak value of the load current, and a comparator which compares an output of the current detection circuit with an output of the threshold adjustment section. The drive signal generator may determine the ON time of the high frequency drive signal according to an output of the comparator Preferably, the drive signal generator changes the ON time of the high frequency drive signal such that the peak value of the load current increases during a predetermined period from when the PWM signal has been changed from OFF to ON, and changes the ON time of the high frequency drive signal such that, after the predetermined period has elapsed, the peak value of the load current gradually drops along the envelope of the specific slope.

The drive signal generator may change the ON time of the high frequency drive signal such that the peak value of the load current increases during a predetermined period from when the PWM signal has been changed from OFF to ON, and may change the ON time of the high frequency drive signal such that after the predetermined period has elapsed, the peak value of the load current gradually drops along the envelope indicating the specific slope.

The lighting device may further include a current detection circuit which detects the load current flowing through the solid state light emitting elements, and the control circuit may further include a threshold adjustment section which includes a capacitor to determine the peak value of the load current, and a comparator which compares an output of the current detection circuit with an output of the threshold adjustment section, in which the threshold adjustment section may include a charging/discharging circuit which switches between charging and discharging of the capacitor for an ON period and an OFF period of the PWM signal, and a voltage of the capacitor is the output of the threshold adjustment section.

Further, the lighting device may includes a current detection circuit which detects the load current flowing through the solid state light emitting elements, and the control circuit may further include a threshold adjustment section which determines the peak value of the load current, and a comparator which compares a superimposition of an output of the current detection circuit and an output of the threshold adjustment section with a predetermined reference voltage.

The lighting device may further comprise a current detection circuit which detects the load current flowing through the solid state light emitting elements. The control circuit may further include a threshold adjustment section which includes a capacitor to determine the peak value of the load current, and a comparator which compares an output of the current detection circuit with an output of the threshold adjustment section. The threshold adjustment section may include a charging/discharging circuit which switches between charging and discharging of the capacitor for an ON period and an OFF period of the PWM signal, and a voltage of the capacitor may be the output of the threshold adjustment section. The comparator may compare a superimposition of an output of the current detection circuit and an output of the threshold adjustment section with a predetermined reference voltage.

Preferably, the diode and the series circuit of the inductor and the switching element are provided between the DC power source and the solid state light emitting elements serves as a step-down chopper circuit.

The diode and the series circuit of the inductor provided between the DC power source and the solid state light emitting elements and the switching element may constitute a step-down chopper circuit.

Further, the control circuit may have a zero current detection section which detects a zero current state where a current flowing through the inductor becomes substantially zero, and performs an operation in a boundary current mode in which the high frequency drive signal is outputted by the drive signal generator when the zero current detection section detects the zero current state.

Furthermore, the control circuit may operate in a discontinuous mode of the load current.

Furthermore, the control circuit may operate in a continuous mode of the load current.

The control circuit may have a zero current detection section which detects a zero current state where a current flowing through the inductor becomes substantially zero. If the zero current detection section detects the zero current state, an operation may be performed in a current critical mode in which the high frequency drive signal is outputted by the drive signal generator. The control circuit may operate the load current in a discontinuous mode or may operate the load current in a continuous mode.

The DC power source may include an AC/DC converter or DC/DC converter. Further, the DC power source may include an AC/DC converter, and a frequency of the PWM signal may be set to 600 Hz or an integer multiple of 600 Hz.

The DC power source may include an AC/DC converter or DC/DC converter. When the DC power source includes an AC/DC converter, a frequency of the PWM signal may be set to 600 Hz or an integer multiple of 600 Hz.

In accordance with another aspect of the present invention, there is provided an illumination apparatus comprising the solid state light emitting elements and the lighting device as described above.

In accordance with another aspect of the present invention, there is provided an illumination apparatus comprising the solid state light emitting elements and the lighting device.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings which form a part hereof.

(First Embodiment)

Figure 3:
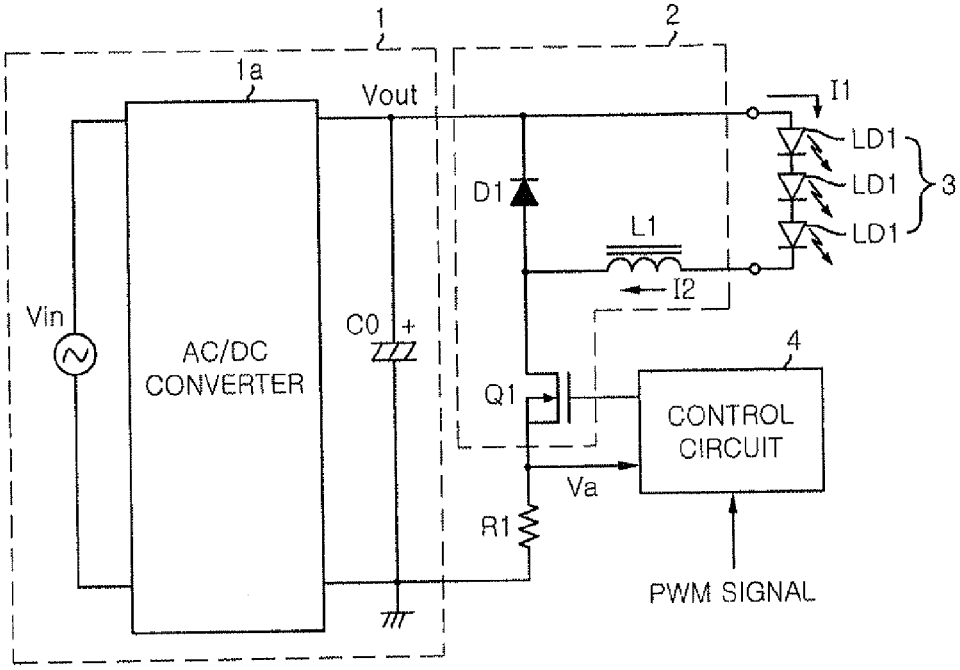
FIG. 3 represents a schematic circuit diagram of the illumination apparatus shown in FIG. 1.

As shown in FIG. 3, An illumination apparatus in accordance with a first embodiment includes a DC power source 1, a lighting device having a step-down chopper circuit 2 and a control circuit 4, and a light source module 3. The illumination apparatus has a dimming function of adjusting a lighting level of the light source module 3 according to the user's operation through a setting operation unit (e.g., an operation unit provided in the illumination apparatus, a dimmer installed on the wall, or the like).

Further, the illumination apparatus in accordance with the embodiment is configured as a power supply integrated illumination apparatus in which the lighting device including the step-down chopper circuit 2 and the control circuit 4 is built in an apparatus body (not shown) with the light source module 3.

The DC power source 1 includes an AC/DC converter 1*a* which full-wave rectifies an AC power supplied from an AC power source such as a commercial power source and converts the rectified AC power into a DC power, and an electrolytic capacitor C0 which is connected between output terminals of the AC/DC converter 1*a*. In this embodiment, the DC power source 1 outputs a DC voltage Vout that is converted from the AC power supplied from the commercial AC 100V power source.

The step-down chopper circuit 2 steps down an output voltage of the DC power source 1 to a desired DC voltage, and supplies a lighting power to the light source module 3. Further, the step-down chopper circuit 2 includes a series circuit of an inductor L1 and a switching element Q1, which is connected between output terminals of the DC power source 1 through the light source module 3. Further, the step-down chopper circuit 2 includes a diode D1 which is connected in parallel to the inductor L1 and the light source module 3 such that the energy stored in the inductor L1 when the switching element Q1 is turned on is regenerated and supplied to the light source module 3 when the switching element Q1 is turned off.

The light source module 3 consists of a series circuit of, e.g., a plurality of (three in this embodiment) light emitting diodes LD1, and is turned on according to the DC power outputted from the step-down chopper circuit 2. In this embodiment, although the three light emitting diodes LD1 is provided in the light source module 3, it is not limited thereto, and the number of the light emitting diodes LD1 may be one, two, four or more. Further, without being limited to the light emitting diodes LD1, the light source module 3 may include other solid state light emitting elements such as organic electroluminescent (EL) elements.

The control circuit 4 controls the on/off of the switching element Q1 of the step-down chopper circuit 2 according to a low frequency PWM signal inputted from the outside, and controls the light source module 3 to be turned on at a dimming level indicated by the PWM signal. The PWM signal is set at a duty ratio in accordance with the dimming level inputted from the above-mentioned setting operation unit. The control circuit 4 controls the on/off of the switching element Q1 such that a current corresponding to the duty ratio of the PWM signal flows through the light source module 3. Further, a resistor R1 in the figure is a resistor for detecting a current value flowing through the switching element Q1. The control circuit 4 detects a current flowing through the switching element Q1 based on a voltage (voltage Va) across the resistor R1.

Figure 1:
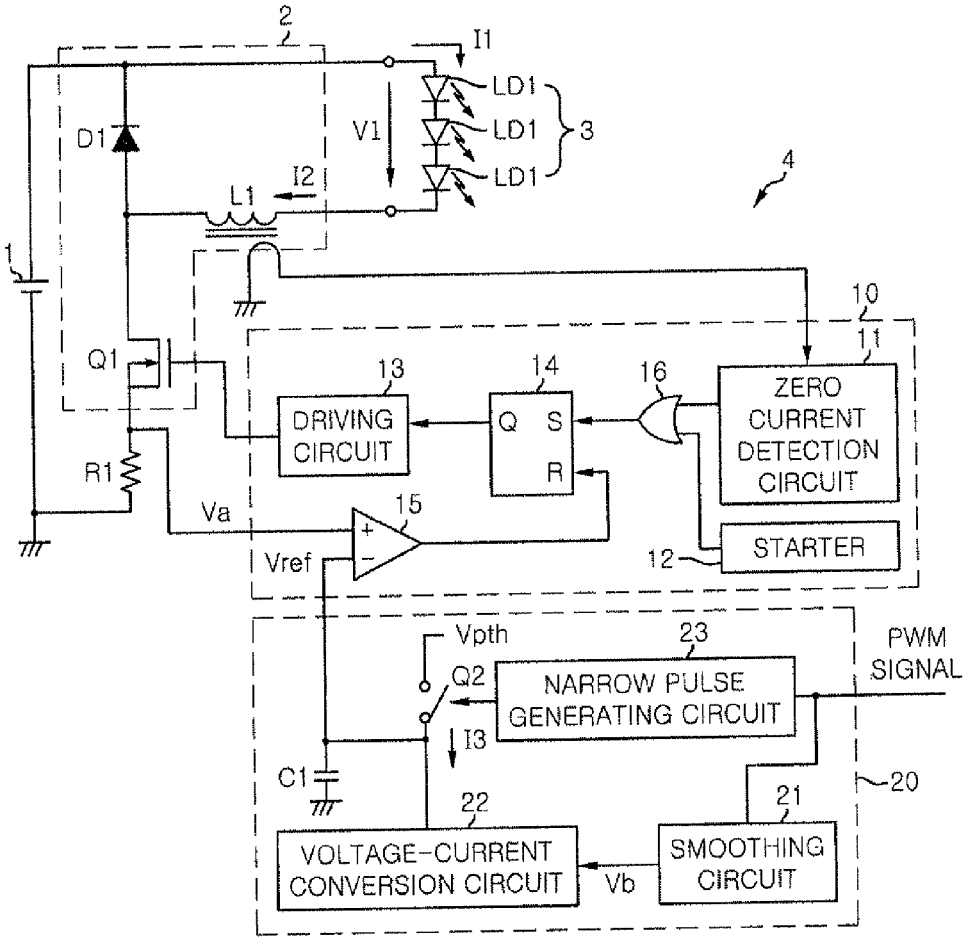
FIG. 1 shows a schematic circuit diagram of an illumination apparatus in accordance with a first embodiment of the present invention.

Here, a specific configuration of the control circuit 4 is shown in a schematic circuit diagram of FIG. 1. The control circuit 4 includes, as shown in FIG. 1, a drive control section 10 which controls the on/off of the switching element Q1, and a threshold adjustment section 20 which outputs a voltage waveform generated by the PWM signal as a reference value of an operation of the drive control section 10.

The drive control section 10 includes a zero current detection circuit 11 which detects that a current flowing through a secondary winding of the inductor L1 becomes substantially zero, and a starter 12 which regularly outputs a start signal at the time of oscillation stop. Further, the drive control section 10 includes a drive pulse generator 14 which generates a drive pulse to turn on/off the switching element Q1, and a drive circuit 13 which drives the switching element Q1 in response to the drive pulse from the drive pulse generator 14. Furthermore, the drive control section 10 includes a comparator 15 which outputs a reset signal to the drive pulse generator 14 when a voltage detected based on the current flowing through the switching element Q1 reaches a reference voltage vref outputted from the threshold adjustment section 20.

The drive pulse generator 14 consists of a RS flip-flop. Inputted to a set terminal of the RS flip-flop is an OR output of a detection signal of the zero current detection circuit 11 and a start signal of the starter 12 via an OR circuit 16. The drive pulse generator 14 outputs a high level signal to the drive circuit 13 when a set signal is inputted from the OR circuit 16. Further, an output of the comparator 15 is inputted to a reset terminal of the RS flip-flop. When the voltage across the resistor R1 reaches the reference voltage Vref outputted from the threshold adjustment section 20, the output of the comparator 15 becomes a high level, and a low level signal from the drive pulse generator 14 is outputted to the drive circuit 13.

The threshold adjustment section 20 includes a smoothing circuit 21 which smoothes the PWM signal into a DC voltage, and a voltage-current conversion circuit 22 which converts an output voltage of the smoothing circuit 21 into a current.

Further, the threshold adjustment section 20 includes a narrow pulse generating circuit 23 which generates a narrow pulse when the PWM signal is changed from low level to high level, and a switching element Q2 which is controlled to turn on and off by the narrow pulse generating circuit 23. Furthermore, the threshold adjustment section 20 includes a capacitor C1 to which a threshold voltage Vpth is applied via the switching element Q2.

In the threshold adjustment section 20, when the input PWM signal is changed from low level to high level, the switching element Q2 is turned on by the narrow pulse generating circuit 23, and the capacitor C1 is charged up to the reference voltage Vref. That is, a charging circuit is constituted by the switching element Q2 and the capacitor C1.

In this case, when the capacitor C1 is charged, the reference voltage Vref is applied to a reference terminal of the comparator 15 of the drive control section 10. Thereafter, by the smoothing circuit 21 and the voltage-current conversion circuit 22, a current I3 corresponding to a voltage Vb in accordance with the duty ratio of the PWM signal flows to the voltage-current conversion circuit 22, so that electric charges of the capacitor C1 are discharged. Accordingly, the reference voltage Vref inputted to the comparator 15 drops linearly. In this way, the threshold adjustment section 20 smoothly changes the reference voltage Vref of the comparator 15 of the drive control section 10 along an envelope of the slope corresponding to the duty ratio of the PWM signal.

Next, an operation of the illumination apparatus in accordance with this embodiment will be described. When the set signal is inputted to the drive pulse generator 14 by an output signal from the starter 12 or the zero current detection circuit 11 while the reference voltage Vref inputted to the comparator 15 is greater than zero, the output of the drive pulse generator 14 becomes a high level. Accordingly, the switching element Q1 is turned on by the drive circuit 13, and a load current I1 flows through the switching element Q1. In this case, when V1 refers to a load voltage of the light source module 3, L1 refers to an impedance of the inductor L1, and t refers to the time from the start of turning on the switching element Q1, the load current I1 is expressed as follows:

$$I1 = \frac{Vout - V1}{L1} t \qquad \text{Eq. 1}$$

At this point, when the voltage across the resistor R1 (I1× resistance value of resistor R1) reaches the reference voltage Vref, the reset signal is inputted to the drive pulse generator 14 by an inverted output of the comparator 15, and the switching element Q1 is turned off. If the switching element Q1 becomes an OFF state, the energy stored in the inductor L1 is regenerated and supplied to the light source module 3 via the diode D1, so that the light source module 3 is turned on by a regenerative current I2. Here, when Ton refers to an ON period of the switching element Q1, and Idp refers to a peak current flowing through the inductor L1, the regenerative current I2 of the inductor is expressed as follows:

$$I2 = -\frac{V1}{L1}(t - Ton) + Idp \qquad \text{Eq. 2}$$

Further, when the regenerative current I2 becomes zero and the current is inverted by action of the inductor L1, electric charges accumulated in the switching element Q1 are discharged. As a result, a drain-source voltage of the switching element Q1 is reduced, and the voltage of the inductor L1 is inverted. Such a voltage inversion is detected by the zero current detection circuit 11, and the zero current detection circuit 11 outputs the set signal to the drive pulse generator 14.

Accordingly, immediately after the current I2 flowing through the inductor L1 becomes zero, the switching element Q1 is turned on again. Further, by repeating these operations, a chopper operation is performed. In this embodiment, the operation is performed in a so-called boundary current mode in which the switching element Q1 is switched from OFF to ON at a timing when the current I2 flowing through the inductor L1 becomes zero.

By the current I2 intermittently flowing in the light source module 3, the light source module 3 is turned on at a specific dimming level. Further, although an light output of the light source module 3 is changed according to a change in the current I2, no flicker is noticed because the light output is changed at a sufficiently high frequency compared to the sensitivity of the human eye.

Figure 2:
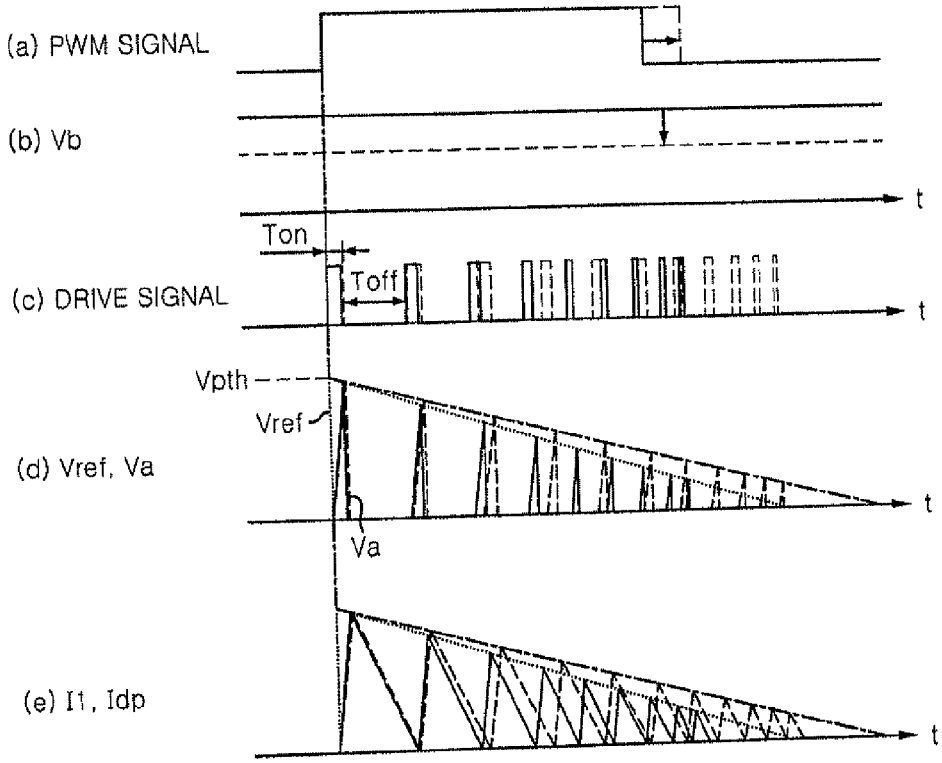
FIG. 2 illustrates schematic graphs for explaining an operation of the illumination apparatus shown in FIG. 1, wherein (a) shows a waveform of a PWM signal, (b) shows an output voltage of a smoothing circuit, (c) shows a high frequency drive pulse, (d) shows a reference voltage Vref and a voltage Va, and (e) shows a load current I1 flowing through a light source module 3 and a peak value Idp.

Here, in case that the PWM signal is changed as shown in (a) of FIG. 2, the voltage Vb outputted from the smoothing circuit 21, the drive signal from the drive pulse generator 14, the reference voltage Vref and the current I1 flowing through the light source module 3 are shown in (b) to (e) of FIG. 2. When the PWM signal corresponding to the duty ratio indicated by a solid line in (a) of FIG. 2 is inputted, the capacitor C1 of the threshold adjustment section 20 is charged based on the threshold voltage Vpth and then electric charges of the capacitor C1 gradually decreases. At this point, the reference voltage Vref of the comparator 15 changes as shown by a dotted line in (d) of FIG. 2. That is, the reference voltage Vref gradually decreases along an envelope having a specific slope from the time when the PWM signal is changed from low level to high level.

Further, when the duty ratio of the PWM signal is changed as shown by a dashed line in (a) of FIG. 2, and the on-duty of the PWM signal is increased, the voltage Vb outputted from the smoothing circuit is reduced (dashed line in (b) of FIG. 2), and the current I3 discharging the electric charges of the capacitor C1 decreases. Accordingly, since a discharging rate of the capacitor C1 is reduced, the reference voltage Vref slowly drops (dashed dotted line in (d) of FIG. 2).

That is, the reference voltage Vref inputted to the comparator 15 drops gradually along the envelope having a specific slope after the PWM signal is changed from low level to high level, and the slope of the envelope is changed according to the duty ratio of the PWM signal. Thus, the current flowing through the light source module 3 is continuously changed in response to continuous changes of the PWM signal so that a change in the light output becomes smoother in a sweep operation. Further, the load current I1 flows until the reference voltage Vref (i.e., the voltage across the capacitor C1) becomes zero.

Herein, the ON period Ton and OFF period Toff of the switching element Q1 are expressed as follows from Eqs. 1 and 2.

$$Ton = \frac{L1}{Vout - V1} - Idp \qquad \text{Eq. 3}$$

$$Toff = \frac{L1}{V1} Idp \qquad \text{Eq. 4}$$

When Don refers to the on-duty of the switching element Q1, it is expressed as follows from Eqs. 3 and 4.

$$Don = \frac{Ton}{Ton + Toff} = \frac{V1}{Vout} \quad \text{Eq. 5}$$

That is, the on-duty Don of the switching element Q1 is determined by the output voltage Vout of the DC power source 1 and the load voltage V1 of the light source module 3. Here, if a ratio of the load voltage V1 to the output voltage Vout is referred to as K, the output voltage Vout may be defined as K×V1 (Vout=K×V1), and K=1/Don may be obtained from Eq. 5.

Meanwhile, assuming that the frequency of the drive pulse is constant, the larger the on-duty of the switching element Q1, the less a reduction in the peak current Idp flowing through the inductor L1, thereby suppressing a steep change in peak current. Further, since the last waveform of the triangular current of the inductor L1 corresponds to a minimum resolution of the current change of the light source module 3, the light output becomes smoother as the on-duty is larger.

Therefore, as the ratio K of the load voltage V1 to the output voltage Vout is smaller, the light output becomes smoother. Considering the stability and accuracy of the operation, K≤5.0 is preferred. That is, by setting the output voltage Vout of the DC power source 1 to be equal to or less than 5.0 times the load voltage V1 of the light source module, it is possible to further reduce flickering in the light output of the light source module 3. Further, in order to enable a step-down chopper operation, the lower limit of the output voltage Vout needs to be larger than the load voltage V1 (i.e., K>1), and it is preferable to set K≥1.2 considering changes in the load voltage V1 due to temperature characteristics of the light source module 3.

Further, in this embodiment, the commercial AC power source having a frequency of 50 Hz or 60 Hz is used as an input power source of the AC/DC converter 1*a*. Accordingly, by the capacitance of the electrolytic capacitor C0, a ripple of 100 Hz or 120 Hz may appear in the output voltage Vout. Therefore, in order to avoid the flicker in the light output due to interference between the ripple and the frequency of the PWM signal, the frequency of the PWM signal is set to 600 Hz or an integer multiple of 600 Hz. In this way, even if the frequency is either 50 Hz or 60 Hz, the light output becomes almost constant, and it is possible to suppress the flicker.

As described above, after the low frequency PWM signal is changed from low level to high level, the peak current Idp flowing through the light source module 3 gradually drops along the envelope of the slope corresponding to the duty ratio of the PWM signal. Thus, it is possible to smooth a change in illumination of the light source module 3 even at a low dimming level without increasing a drive frequency of the drive pulse generator 14. Further, even when the light source module 3 is seen through video equipment such as video cameras, it is possible to reduce the flicker that interferes with a specific frequency of the video equipment.

Further, although the DC power source 1 includes the commercial power source and the AC/DC converter 1*a* in this embodiment, a DC/DC converter may be provided in the DC power source, or a DC power source may be directly connected.

Figure 4:
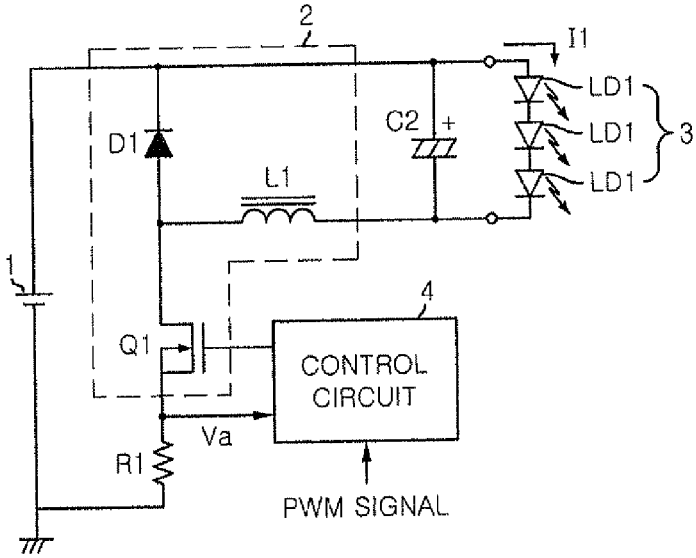
FIG. 4 depicts a schematic circuit diagram of another example of the illumination apparatus shown in FIG. 1.

As shown in FIG. 4, a capacitor C2 consisting of an electrolytic capacitor may be provided in parallel with the light source module 3. With this configuration, the load current II of the light source module 3 is smoothed by the capacitor C2, and it is possible to reduce the ripple in the load current I1.

Figure 5:
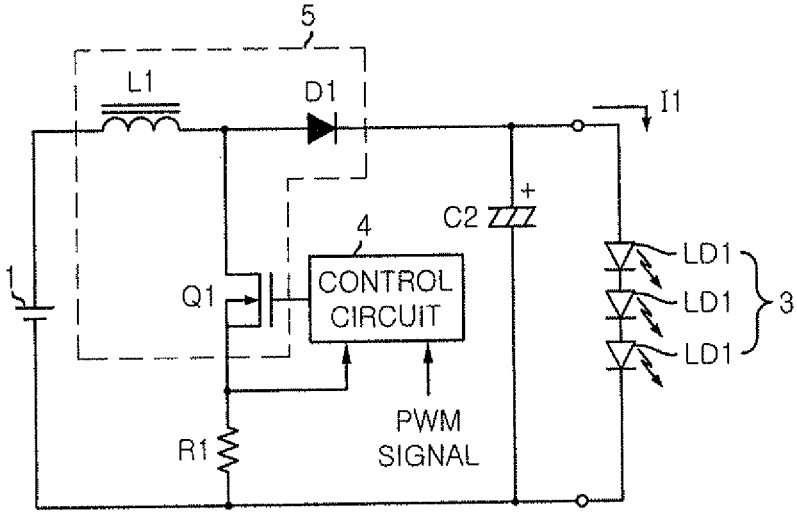
FIG. 5 illustrates a schematic circuit diagram of still another example of the illumination apparatus shown in FIG. 1.
Figure 6:
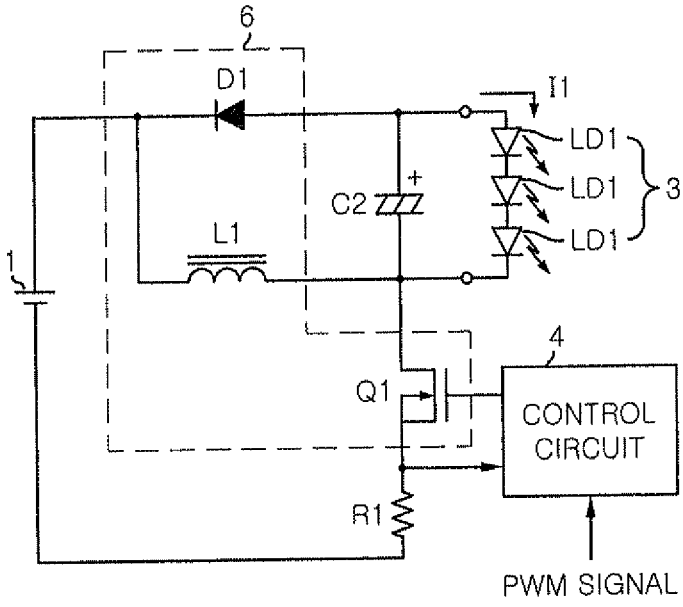
FIG. 6 shows a schematic circuit diagram of still another example of the illumination apparatus shown in FIG. 1.
Figure 7:
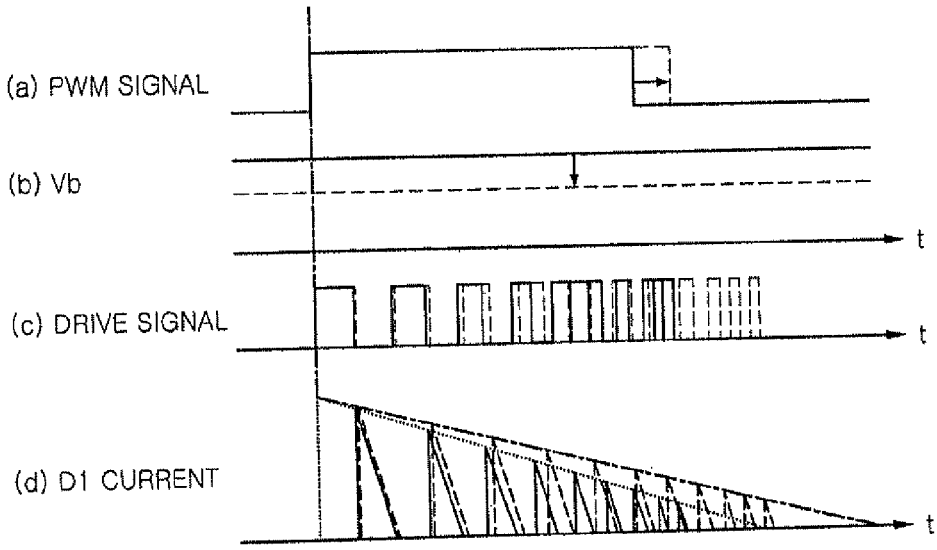
FIG. 7 illustrates schematic graphs (a) to (d) showing an operation state of the illumination apparatuses shown in FIGS. 5 and 6.

Further, although the light source module 3 is driven by using the step-down chopper circuit 2 in this embodiment, a step-up chopper circuit 5 as shown in FIG. 5 may be used, and a step-up/down chopper circuit 6 as shown in FIG. 6 may be used. In this case, the on/off of the switching element Q1 included in the step-up chopper circuit 5 or the step-up/down chopper circuit 6 is controlled by the control circuit 4 as described above, so that a current Dl flowing through the diode D1 is changed as shown in (d) of FIG. 7.

Accordingly, as in the case of using the step-down chopper circuit 2, the load current I1 flowing through the light source module 3 gradually drops along the envelope of the slope corresponding to the duty ratio of the PWM signal. Thus, it is possible to smooth a change in illumination of the light source module 3 even at a low dimming level without increasing the drive frequency of the drive pulse generator 14.

(Second Embodiment)

Figure 8:
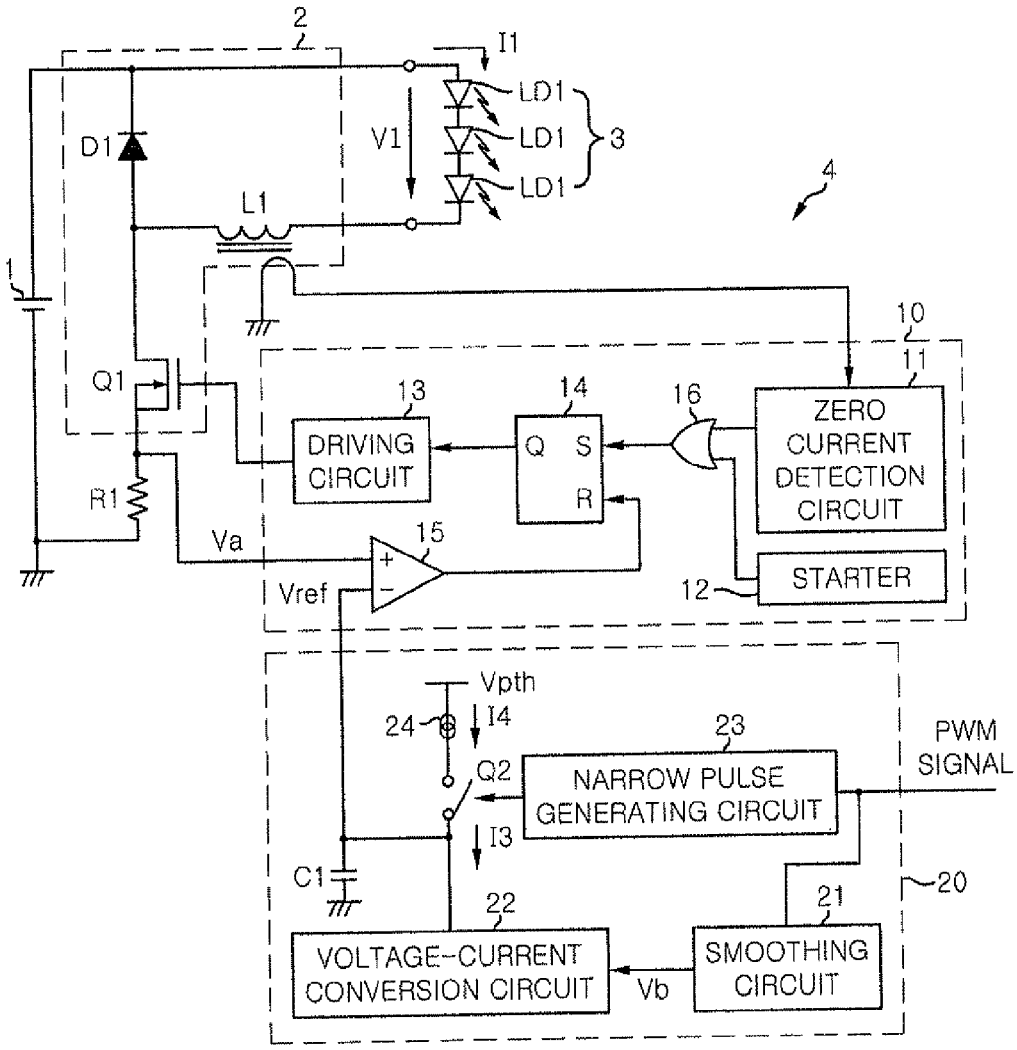
FIG. 8 depicts a schematic circuit diagram of an illumination apparatus in accordance with a second embodiment of the present invention.

An illumination apparatus in accordance with a second embodiment of the present invention will be described with reference to FIGS. 8 and 9. In the illumination apparatus in accordance with this embodiment, as shown in FIG. 8, a constant current source 24 is provided on the front end of a switch Q2. The Other configuration of second embodiment is identical to that of the first embodiment except for this difference, the same reference numerals are assigned to the same elements, and a description thereof is omitted.

In the threshold adjustment section 20, in the same way as in the first embodiment, when the input PWM signal is changed from low level to high level, the switching element Q2 is turned on by the narrow pulse generating circuit 23 and the capacitor C1 is charged. At this time, a constant current 14 flows from the constant current source 24, and a charging rate of the capacitor C1 is determined by a difference (I4-I3) between the constant current I4 and the current I3.

Figure 9:
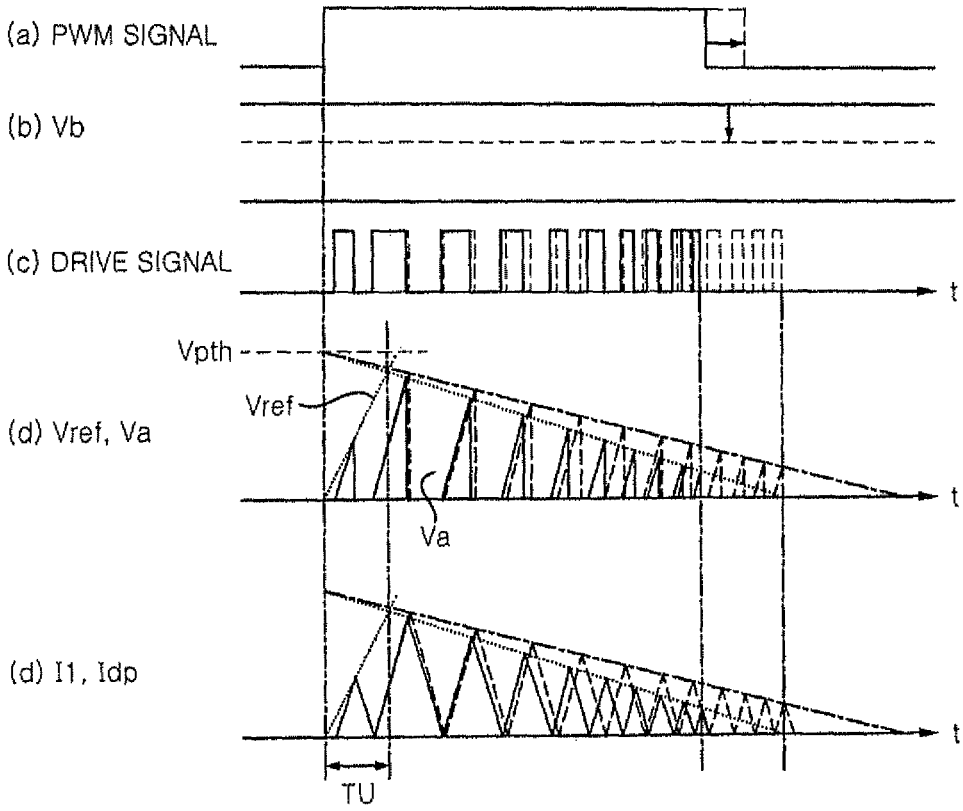
FIG. 9 represents schematic graphs (a) to (e) for explaining an operation of the illumination apparatus shown in FIG. 8.

Therefore, as shown in (d) of FIG. 9, the reference voltage Vref slowly rises during a rising period TU after the PWM signal is changed from low level to high level. Further, a peak value of the reference voltage Vref is determined by a width TU of a pulse signal outputted from the narrow pulse generating circuit 23 and a magnitude of the constant current I4, and the peak value may be set to a value lower than the threshold voltage Vpth.

In this way, the peak value of the reference voltage Vref is lowered by the gradual rise of the reference voltage Vref. Accordingly, even if the dimming level is low (if the on-duty of the PWM signal is low), the envelope along which the reference voltage Vref drops can be set to have a gentle slope. Therefore, even if the dimming level is low, it is possible to smooth a change in illumination of the light source module 3 without setting the current I3 to a large value.

(Third Embodiment)

Figure 10:
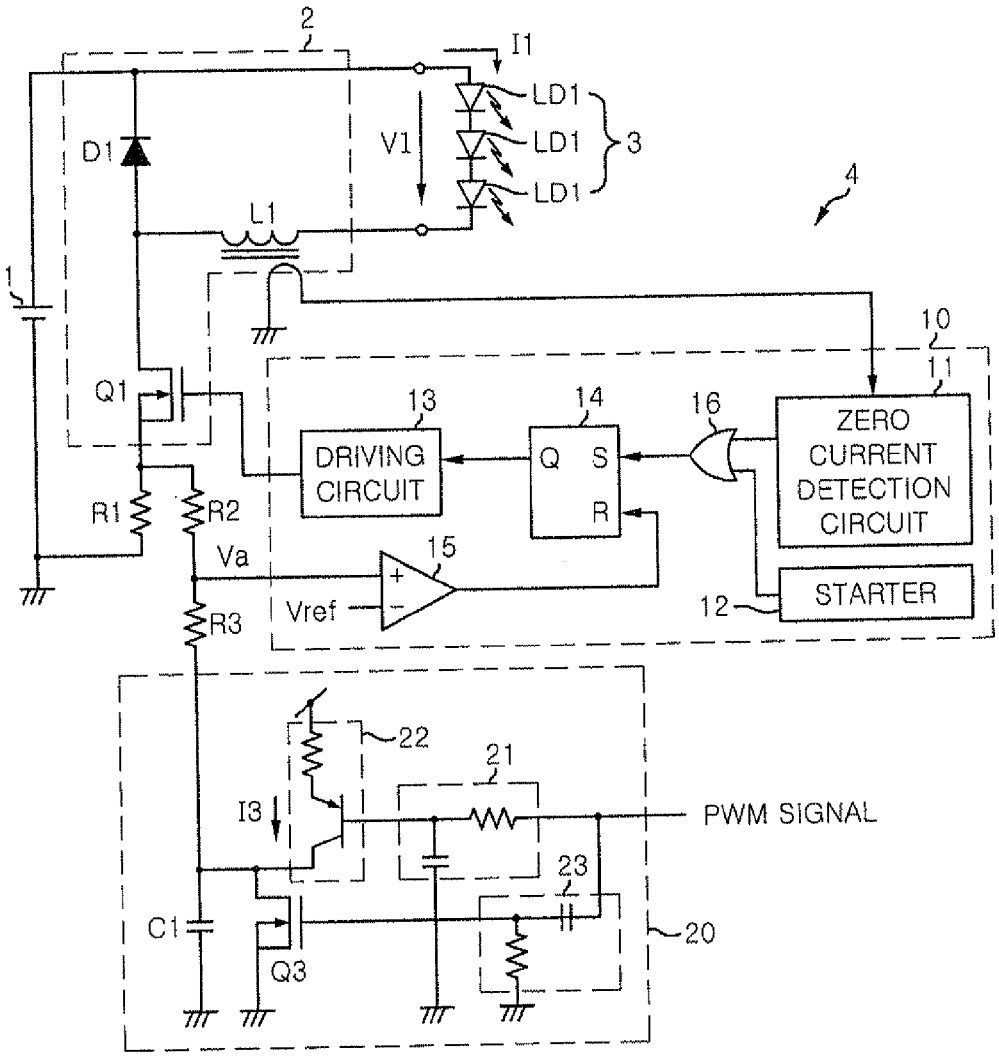
FIG. 10 shows a schematic circuit diagram of an illumination apparatus in accordance with a third embodiment of the present invention.

An illumination apparatus in accordance with a third embodiment will be described with reference to FIGS. 10 and 11. In the illumination apparatus in accordance with this embodiment, as shown in FIG. 10, a general-purpose IC for PFC (e.g., MC33262 manufactured by ON Semiconductor Corp. and L6562 manufactured by STMicroelectronics, Inc.) internally generating the reference voltage Vref is used as the comparator 15.

Further, the voltage across the resistor R1 is inputted to the comparator 15 via a resistor R2. Also, the capacitor C1 (i.e., the output of the threshold adjustment section 20) is connected to the resistor R2 via a resistor R3. The other configuration of the third embodiment is identical to that of the first embodiment except for this difference, the same reference numerals are assigned to the same elements, and a description thereof is omitted.

In this illumination apparatus, if the PWM signal is changed from low level to high level, the switching element Q3 is turned on for a short time such that the capacitor C1 is discharged and a voltage across the capacitor C1 becomes zero. Then, when the switching element Q3 is turned on by the narrow pulse generating circuit 23, the capacitor C1 is charged by the current I3 from the voltage-current conversion circuit 22, and the voltage across the capacitor C1 gradually increases up to the threshold voltage Vpth.

Further, a comparison voltage Va being inputted to the comparator 15 is a sum of the voltage across the resistor R1 and the voltage across the capacitor C1, each being multiplied by a coefficient determined by the resistor R2 and the resistor R3. Thus, the comparison voltage Va being inputted to the comparator 15 gradually increases along a slope determined by the duty ratio of the PWM signal and resistance values of the resistor R2 and the resistor R3 as the voltage across the capacitor C1 increase (see (a) and (d) of FIG. 11).

Figure 11:
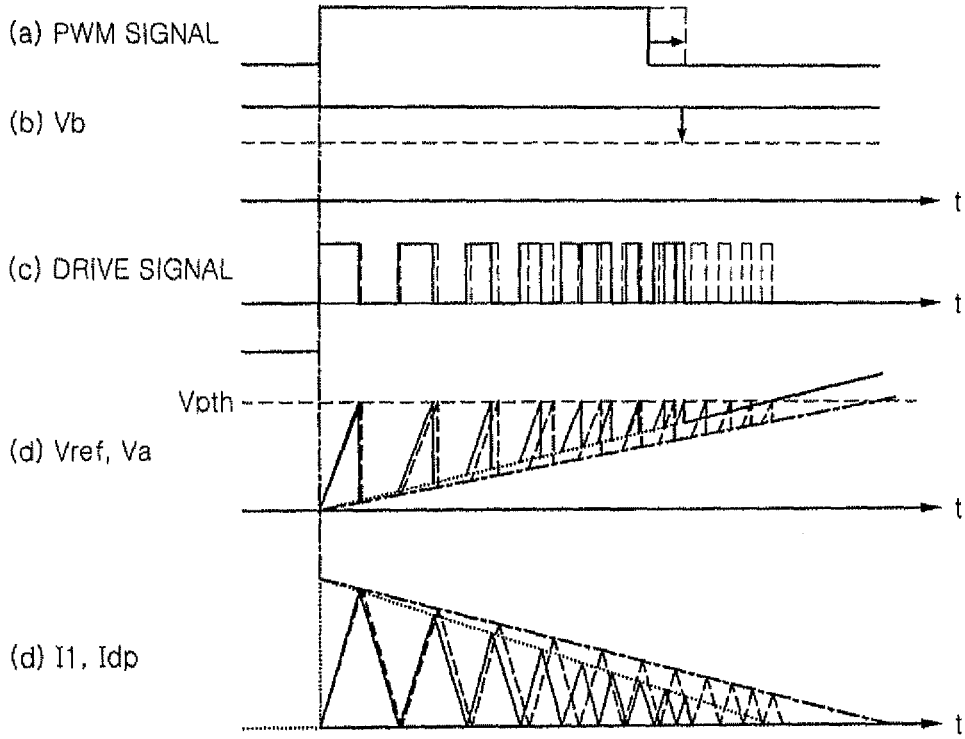
FIG. 11 illustrates schematic graphs (a) to (e) for explaining an operation of the illumination apparatus shown in FIG. 10.

Accordingly, the peak value of the load current I1 gradually decreases along with the increase of the voltage across the capacitor C1 (see (e) of FIG. 11). Further, if the comparison voltage Va exceeds the internal reference voltage Vref of the comparator 15, the output of the drive pulse generator 14 becomes a low level such that the drive circuit 13 is stopped and the load current I1 flowing through the light source module 3 becomes zero. Thus, the light source module 3 is turned off.

With such configuration, although it is impossible to directly change the reference voltage Vref of the comparator 15, it is possible to reduce the light output along the envelope of the slope corresponding to the duty ratio of the PWM signal. In this embodiment, since the comparator 15 consists of a general-purpose IC for PFC, it is possible to reduce the number of parts of the drive control section 10.

(Fourth Embodiment)

Figure 12:
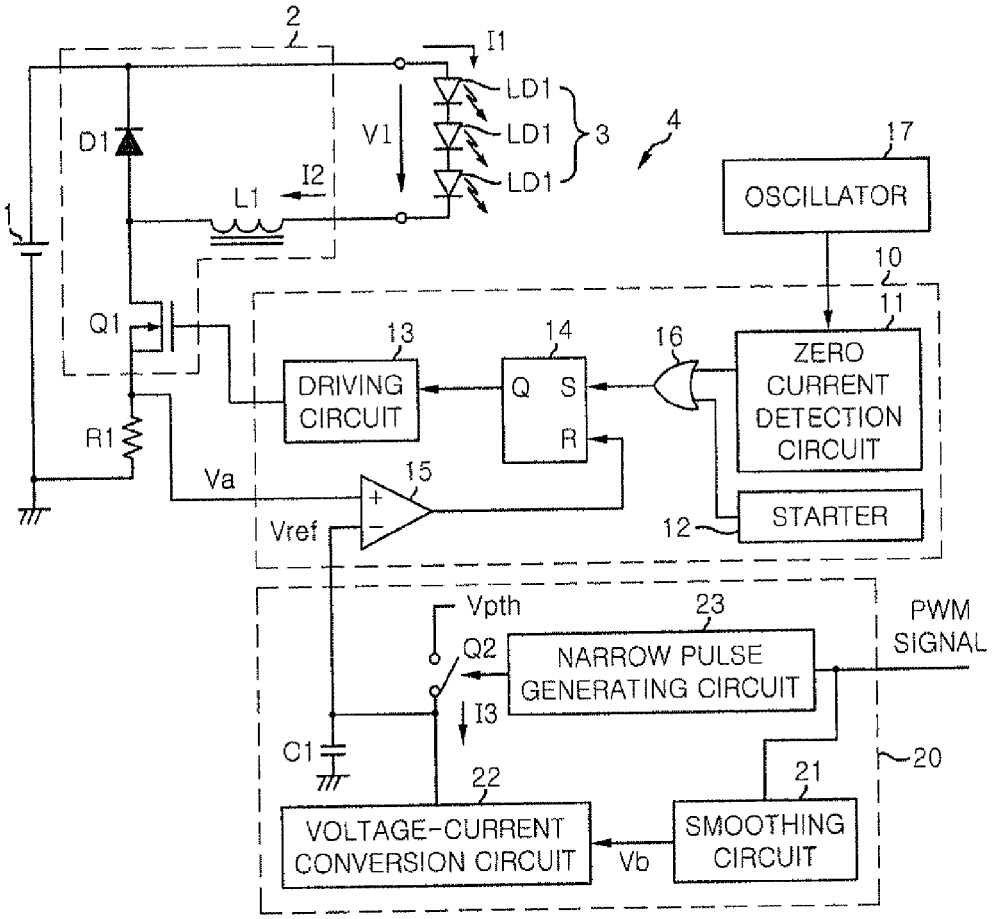
FIG. 12 depicts a schematic circuit diagram of an illumination apparatus in accordance with a fourth embodiment of the present invention.

An illumination apparatus in accordance with a fourth embodiment will be described with reference to FIGS. 12 and 13. In the illumination apparatus in accordance with this embodiment, as shown in FIG. 12, an oscillator 17 outputting a pulse wave with a constant frequency is connected to the zero current detection circuit 11. The other configuration of the fourth embodiment is identical to that of the first embodiment except for this difference, the same reference numerals are assigned to the same elements, and a description thereof is omitted.

Figure 13:
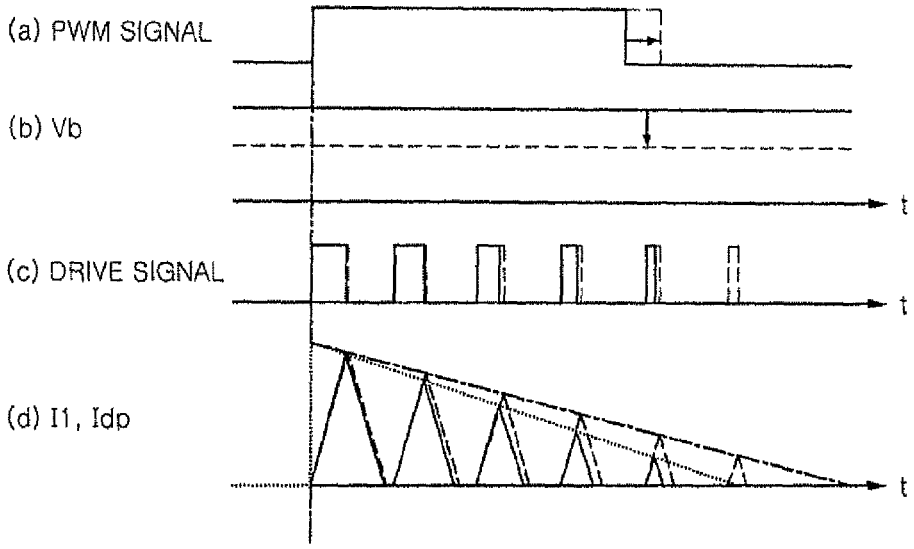
FIG. 13 represents schematic graphs (a) to (d) for explaining an operation of the illumination apparatus shown in FIG. 12.

In this illumination apparatus, the pulse wave with a constant frequency is inputted to the zero current detection circuit 11 from the oscillator 17, the ON period of the switching element Q1 is changed, while the drive frequency remains constant, according to a change in the reference voltage Vref of the comparator 15 (see FIG. 13). Accordingly, there occurs a period during which no current flows through the inductor L1 (see (d) of FIG. 3), and this control mode is called a discontinuous mode.

Even in this case, the load current I1 flowing through the light source module 3 decreases along with the decrease in the reference voltage Vref that is the output of the threshold adjustment section 20, the peak current decreases along the envelope, and the light output of the light source module 3 is also reduced. In other words, the light output is reduced along the envelope of the slope corresponding to the duty ratio of the PWM signal. Therefore, it is possible to smooth the change in illumination of the light source module 3 even at a low dimming level.

Further, although the configuration using the zero current detection circuit 11 has been described in this embodiment, it is not strictly necessary, and an IC for PWM control or the like may be used without being limited thereto.

(Fifth Embodiment)

Figure 14:
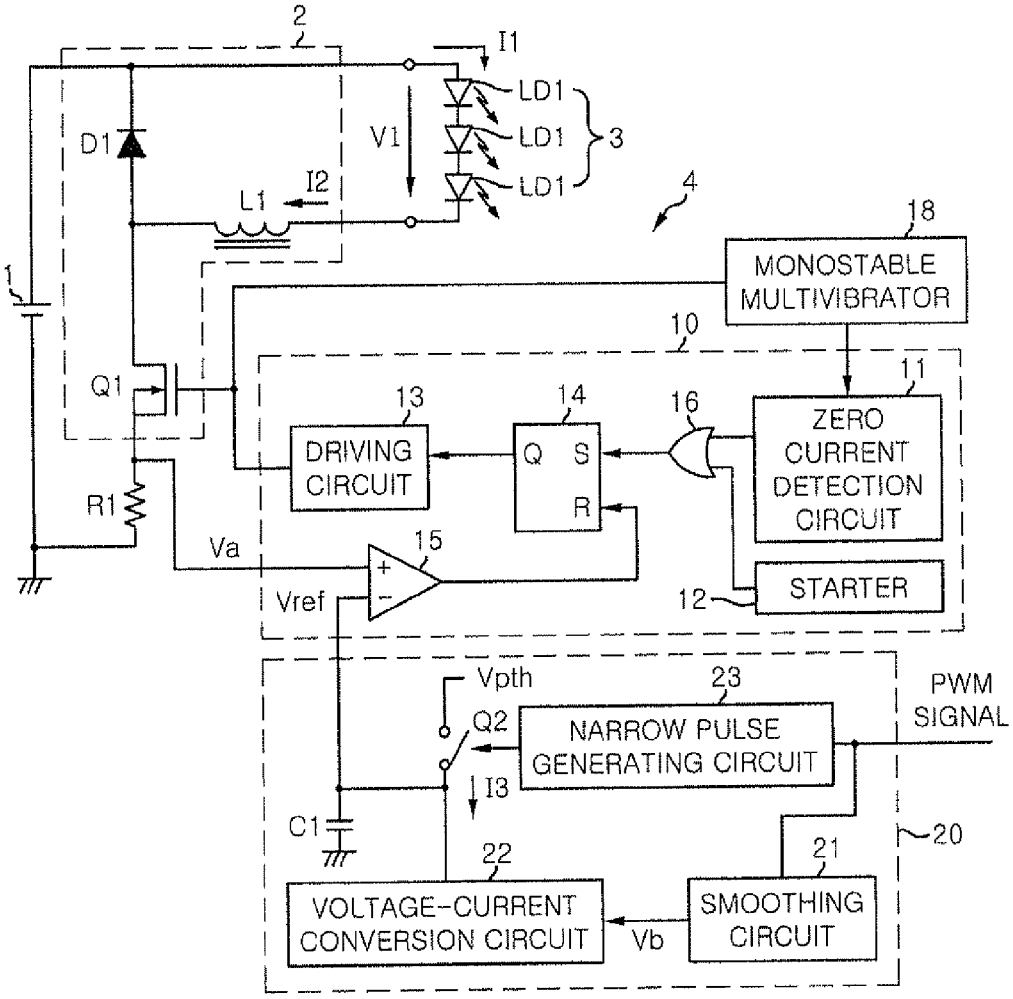
FIG. 14 shows a schematic circuit diagram of an illumination apparatus in accordance with a fifth embodiment of the present invention.

An illumination apparatus in accordance with a fifth embodiment will be described with reference to FIGS. 14 and 15. The illumination apparatus in accordance with this embodiment includes, as shown in FIG. 14, a monostable multi vibrator 18 which provides an output to the zero current detection circuit 11 when a predetermined period Toff has elapsed from the time when the output of the drive circuit 13 is off. Since the fifth embodiment is identical to the first embodiment except for this difference, the same reference numerals are assigned to the same elements, and a description thereof is omitted.

In this illumination apparatus, in the same way as in the first embodiment, the drive pulse is outputted from the drive pulse generator 14 by an output signal from the starter 12 or the zero current detection circuit 11 while the reference voltage Vref is greater than zero, the switching element Q1 is turned on by the drive circuit 13. Then, a reset signal from the comparator 15 is inputted to the drive pulse generator 14, and the drive circuit 13 sets the switching element Q1 in an OFF state. After that, when the predetermined period Toff has elapsed, the zero current detection circuit 11 generates an output signal in response to the output from the monostable multivibrator 18. Accordingly, the drive pulse is outputted from the drive pulse generator 14, and the switching element Q1 is turned on by the drive circuit 13.

Figure 15:
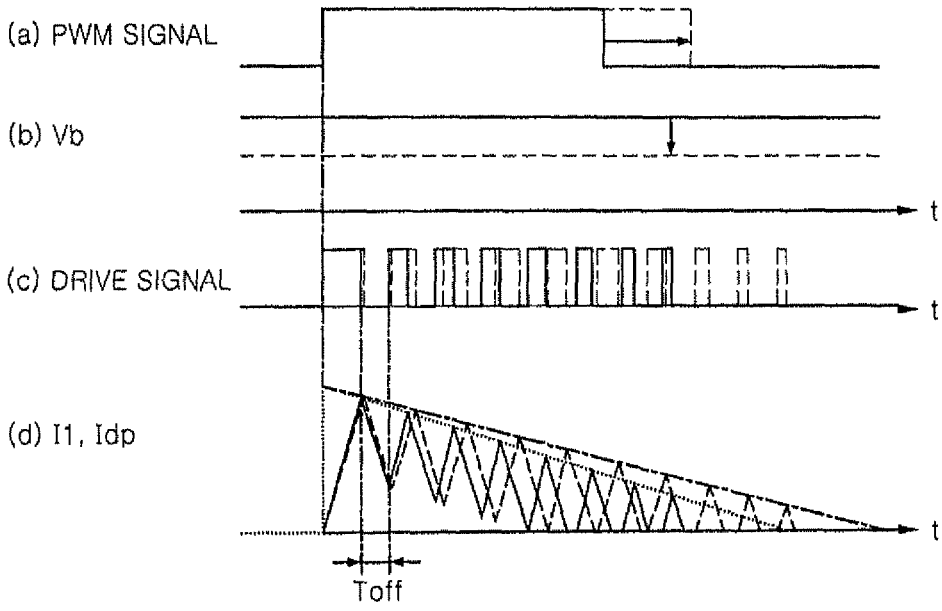
FIG. 15 illustrates schematic graphs (a) to (d) for explaining an operation of the illumination apparatus shown in FIG. 14.

Thus, as shown in FIG. 15, the switching element Q1 initially operates in a continuous mode in which the current continuously flows in the inductor L1, and the load current I1 of the light source module 3 is reduced along the envelope of the slope corresponding to the duty ratio of the PWM signal. Then, due to the decrease in current, the switching element Q1 operates in a discontinuous mode in which there occurs a period during which no current flows through the inductor L1. Even in this case, the load current I1 of the light source module 3 is reduced along the envelope of the slope corresponding to the duty ratio of the PWM signal. Therefore, it is possible to smooth the change in illumination of the light source module 3.

As the above, although the configuration using the zero current detection circuit 11 has been described in this embodiment, it is not strictly necessary, and an IC for PWM control or the like may be used without being limited thereto.

(Sixth Embodiment)

Figure 16:
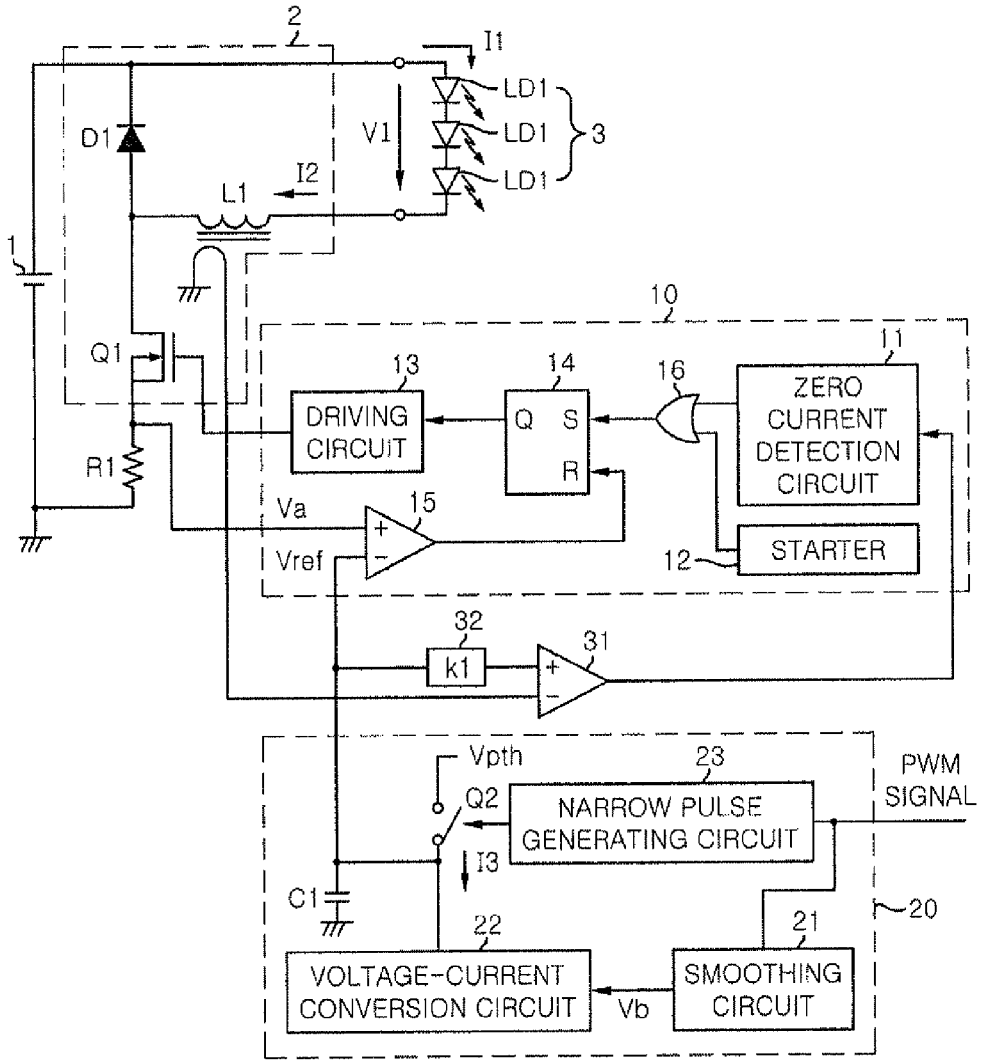
FIG. 16 shows a schematic circuit diagram of an illumination apparatus in accordance with a sixth embodiment of the present invention.

An illumination apparatus in accordance with a sixth embodiment will be described with reference to FIGS. 16 and 17. The illumination apparatus in accordance with this embodiment includes, as shown in FIG. 16, an attenuator 32 which attenuates the reference voltage Vref by a predetermined multiple (k1 times), and a comparator 31 which compares the output voltage of the attenuator 32 with the voltage across the secondary winding of the inductor L1 to output the comparison results to the zero current detection circuit 11.

In this illumination apparatus, when the voltage across the resistor R1 exceeds the reference voltage Vref outputted from the threshold adjustment section 20, the reset signal is outputted to the drive pulse generator 14 from the comparator 15 so that the switching element Q1 is turned off. Further, when the voltage across the secondary winding of the inductor L1 is lower than the reference voltage Vref multiplied by k1 times ($k1<1$) by the attenuator 32, a signal is outputted from the comparator 31 to the zero current detection circuit 11, and a set signal is applied to the drive pulse generator 14 so that the switching element Q1 is turned on.

In other words, a threshold Ith1 of the load current I1 is determined according to the voltage across the capacitor C1, and a threshold Ith2 (threshold Ith2<threshold Ith1) is determined according to the voltage across the capacitor C1 multiplied by k1 times. Further, when the load current I1 rises up to the threshold Ith1, the switching element Q1 is turned off. Then, when the load current I1 drops down to the threshold Ith2, the switching element Q1 is turned on, and these operations are repeated. Since the sixth embodiment is identical to the first embodiment except for this difference, the same reference numerals are assigned to the same elements, and a description thereof is omitted.

In this illumination apparatus, in the same way as in the first embodiment, when the drive pulse is outputted from the drive pulse generator 14 in response to the output signal from the starter 12 or the zero current detection circuit 11 while the reference voltage Vref is greater than zero, the switching element Q1 is turned on by the drive circuit 13. Then, when the reset signal from the comparator 15 is inputted to the drive pulse generator 14, the drive circuit 13 sets the switching element Q1 in an OFF state. Accordingly, the energy stored in the inductor L1 is regenerated and supplied to the light source module 3 via the diode D1, so that the voltage across the secondary winding of the inductor L1 is reduced.

Further, when the voltage across the secondary winding of the inductor L1 is lower than the reference voltage Vref multiplied by k1 times, the output of the comparator 31 is inverted. The zero current detection circuit 11 detects that the output of the comparator 31 is inverted and outputs a signal. Accordingly, the set signal is inputted to the drive pulse generator 14, and the switching element Q1 is turned on. Thus, the switching element Q1 operates in a continuous mode in which a current corresponding to the reference voltage Vref multiplied by k1 times serves as a lower limit.

Figure 17:
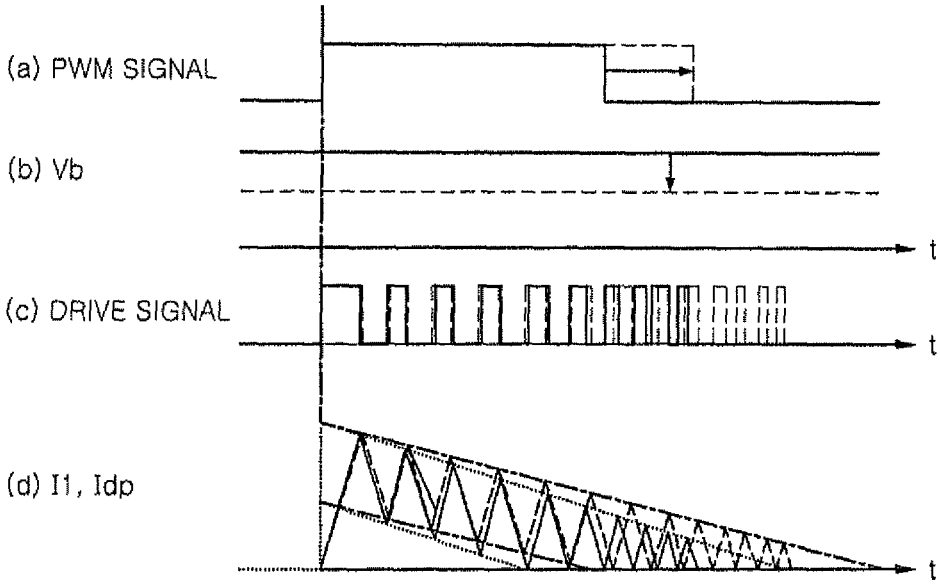
FIG. 17 illustrates schematic graphs (a) to (d) for explaining an operation of the illumination apparatus shown in FIG. 16.
Figure 18:
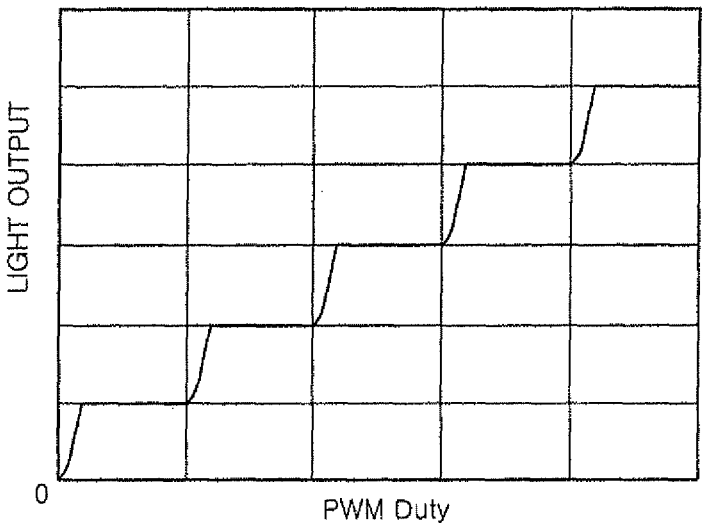
FIG. 18 is a schematic graph showing an operation of a conventional illumination apparatus.

Thus, as shown in FIG. 17, the switching element Q1 operates in the continuous mode in which the reference voltage Vref multiplied by k1 times is set as a lower limit, and the load current I1 of the light source module 3 is reduced along the envelope of the slope corresponding to the duty ratio of the PWM signal. Further, when the threshold Ith2 becomes substantially zero, the switching element Q1 operates in a discontinuous mode, and the load current I1 of the light source module 3 is reduced along the envelope of the slope corresponding to the duty ratio of the PWM signal. Therefore, as in the first embodiment, it is possible to smooth the change in illumination of the light source module 3.

Further, although the configuration using the zero current detection circuit 11 has been described in this embodiment, it is not strictly necessary, and an IC for PWM control or the like may be used without being limited thereto.

While the invention has been shown and described with respect to each of the embodiments, it may be composed with combinations of the embodiments.

Further, While the invention has been shown and described with respect to the embodiments, it will be understood by those skilled in the art that various changes and modification may be made without departing from the scope of the invention as defined in the following claims.

What is claimed is:

1. A lighting device comprising:

a series circuit of an inductor and a switching element which is connected between output terminals of a DC power source, wherein the switching element operates for switching an input from the DC power source;

a diode which regenerates and supplies an energy of the inductor to solid state light emitting elements when the switching element is turned off; and a control circuit which controls on/off of the switching element, wherein the control circuit includes a drive signal generator which outputs a high frequency drive signal as a pulse signal to determine an amplitude of a load current flowing through the solid state light emitting elements; and a drive control section which turns on and off the switching element based on the high frequency drive signal and a PWM signal with a frequency lower than that of the high frequency drive signal, an on-duty of the PWM signal being changed according to a dimming level, and wherein the drive signal generator changes an ON time of the high frequency drive signal such that, after the PWM signal is changed from OFF to ON, a peak value of the load current gradually drops along an envelope of a specific slope, and the specific slope of the envelope is changed based on a duty ratio of the PWM signal.

2. The lighting device of claim 1, further comprising a current detection circuit which detects the load current flowing through the solid state light emitting elements, wherein the control circuit further includes a threshold adjustment section which determines the peak value of the load current, and a comparator which compares an output of the current detection circuit with an output of the threshold adjustment section, and wherein the drive signal generator determines the ON time of the high frequency drive signal based on an output of the comparator.

3. The lighting device of claim 1, wherein the drive signal generator changes the ON time of the high frequency drive signal such that the peak value of the load current increases during a predetermined period from when the PWM signal has been changed from OFF to ON, and changes the ON time of the high frequency drive signal such that, after the predetermined period has elapsed, the peak value of the load current gradually drops along the envelope of the specific slope.

4. The lighting device of claim 1, further comprising a current detection circuit which detects the load current flowing through the solid state light emitting elements, wherein the control circuit further includes a threshold adjustment section which includes a capacitor to determine the peak value of the load current, and a comparator which compares an output of the current detection circuit with an output of the threshold adjustment section, and wherein the threshold adjustment section includes a charging/discharging circuit which switches between charging and discharging of the capacitor for an ON period and an OFF period of the PWM signal, and a voltage of the capacitor is the output of the threshold adjustment section.

5. The lighting device of claim 1, further comprising a current detection circuit which detects the load current flowing through the solid state light emitting elements, wherein the control circuit further includes a threshold adjustment section which determines the peak value of the load current, and a comparator which compares a superimposition of an output of the current detection circuit and an output of the threshold adjustment section with a predetermined reference voltage.

6. The lighting device of claim 1, wherein the diode and the series circuit of the inductor and the switching element provided between the DC power source and the solid state light emitting elements serves as a step-down chopper circuit.

7. The lighting device of claim 1, wherein the control circuit has a zero current detection section which detects a zero current state where a current flowing through the inductor becomes substantially zero, and performs an operation in a boundary current mode in which the high frequency drive signal is outputted by the drive signal generator when the zero current detection section detects the zero current state.

8. The lighting device of claim 1, wherein the control circuit operates in a discontinuous mode of the load current.

9. The lighting device of claim 1, wherein the control circuit operates in a continuous mode of the load current.

10. The lighting device of claim 1, wherein the DC power source includes an AC/DC converter or DC/DC converter.

11. The lighting device of claim 1, wherein the DC power source includes an AC/DC converter, and a frequency of the PWM signal is set to 600 Hz or an integer multiple of 600 Hz.

12. An illumination apparatus comprising the solid state light emitting elements and the lighting device described in claim 1.

* * * * *